US006056142A

United States Patent [19]

Elliott

[11] Patent Number: 6,056,142

[45] **Date of Patent: *May 2, 2000**

[54] SEALED DISPENSING CLOSURE WITH A SEAL PENETRATOR

[75] Inventor: John Elliott, Burlington, Wis.

[73] Assignee: AptarGroup, Inc., Crystal Lake, Ill.

[ * ] Notice: This patent is subject to a terminal disclaimer.

[21] Appl. No.: 09/365,534

[22] Filed: Aug. 2, 1999

Related U.S. Application Data

[63] Continuation of application No. 09/001,151, Dec. 30, 1997, Pat. No. 5,992,668, which is a continuation-in-part of application No. 08/680,252, Jul. 11, 1996, abandoned.

[51] Int. Cl.[7] ..... B65D 17/44

[52] U.S. Cl. ..... 220/278; 215/228; 215/235; 220/259; 220/258; 220/836; 220/837; 220/277; 222/83; 222/541.2

[58] Field of Search ..... 215/232, 235, 215/237, 228, 226, 303; 222/83, 541.2; 220/254, 255, 256, 258, 259, 277, 278, 780, 796, 359, 850, 836–838, 89.2, 89.3

[56] References Cited

U.S. PATENT DOCUMENTS

| | | |
|---|---|---|
| Re. 29,850 | 11/1978 | Labarre . |
| 2,336,490 | 12/1943 | Lo Vico . |
| 2,895,654 | 7/1959 | Rieke . |
| 3,135,441 | 6/1964 | Wise et al. . |
| 3,207,375 | 9/1965 | Bereziat et al. . |
| 3,239,112 | 3/1966 | Porcelli . |
| 3,269,617 | 8/1966 | Goth . |
| 3,278,089 | 10/1966 | Heekin et al. . |
| 3,282,477 | 11/1966 | Henchert . |
| 3,292,828 | 12/1966 | Stuart . |
| 3,310,206 | 3/1967 | Littlefield . |
| 3,406,872 | 10/1968 | Fiquet et al. . |
| 3,434,620 | 3/1969 | Laurizio . |
| 3,458,080 | 7/1969 | Laurizio . |
| 3,459,315 | 8/1969 | Labarre . |
| 3,495,746 | 2/1970 | Laurizio . |
| 3,567,061 | 3/1971 | Song . |
| 3,580,423 | 5/1971 | Gilman . |
| 3,610,484 | 10/1971 | Matzka . |
| 3,661,306 | 5/1972 | Kuckens . |
| 3,834,597 | 9/1974 | Guala . |
| 3,860,152 | 1/1975 | Marti . |
| 3,912,115 | 10/1975 | Smith . |
| 3,924,777 | 12/1975 | Peyser . |
| 3,949,898 | 4/1976 | Patel et al. . |
| 3,990,603 | 11/1976 | Brochman . |
| 4,022,357 | 5/1977 | Dwinell . |
| 4,179,044 | 12/1979 | Fitte . |
| 4,211,334 | 7/1980 | Witten et al. . |
| 4,234,103 | 11/1980 | Strobl et al. . |
| 4,294,382 | 10/1981 | Summers et al. . |
| 4,307,821 | 12/1981 | McIntosh . |
| 4,356,939 | 11/1982 | Fitte . |

(List continued on next page.)

FOREIGN PATENT DOCUMENTS

| | | |
|---|---|---|
| 1 0 570 276 | 11/1993 | European Pat. Off. . |
| 747294 A1 | 12/1996 | European Pat. Off. . |
| WO 95/28274 | 10/1995 | WIPO . |
| WO96/24483 | 8/1996 | WIPO . |
| WO 97/00816 | 1/1997 | WIPO . |
| WO 97/05055 | 2/1997 | WIPO . |

OTHER PUBLICATIONS

"Multi–Material Injection Saves Time, While Cutting Costs," Modern Plastics, Mar. 19, 1994 (Author: Peter Mapleston).

(List continued on next page.)

*Primary Examiner*—Stephen K. Cronin
*Assistant Examiner*—Robin A. Hylton
*Attorney, Agent, or Firm*—Rockey, Milnamow & Katz, Ltd.

[57] ABSTRACT

A closure is provided for a container and includes a base and a lid. The base includes a body for mounting to the container, and the body defines a dispensing orifice. A tamper-evident seal extends across the dispensing orifice. The lid includes a peripheral frame, a flexible panel, and a penetrator member extending from the panel for penetrating the seal.

23 Claims, 7 Drawing Sheets

U.S. PATENT DOCUMENTS

| | | |
|---|---|---|
| 4,483,464 | 11/1984 | Nomura . |
| 4,583,665 | 4/1986 | Barriac . |
| 4,682,702 | 7/1987 | Gach . |
| 4,696,415 | 9/1987 | Meshberg . |
| 4,722,449 | 2/1988 | Dubach . |
| 4,727,999 | 3/1988 | Gach . |
| 4,728,006 | 3/1988 | Drobish et al. . |
| 4,747,501 | 5/1988 | Greaves . |
| 4,749,108 | 6/1988 | Dornsbusch et al. . |
| 4,770,305 | 9/1988 | Su . |
| 4,785,931 | 11/1988 | Weir et al. . |
| 4,795,043 | 1/1989 | Odet et al. . |
| 4,807,769 | 2/1989 | Gach . |
| 4,817,816 | 4/1989 | Leseman et al. . |
| 4,846,236 | 7/1989 | Deruntz . |
| 4,867,326 | 9/1989 | O'Meara . |
| 4,869,399 | 9/1989 | Dubach . |
| 4,909,434 | 3/1990 | Jones et al. . |
| 4,948,003 | 8/1990 | Munoz . |
| 4,969,581 | 11/1990 | Seifert et al. . |
| 4,993,569 | 2/1991 | Osip et al. . |
| 5,005,737 | 4/1991 | Rohr . |
| 5,008,066 | 4/1991 | Mueller . |
| 5,042,690 | 8/1991 | O'Meara . |
| 5,115,950 | 5/1992 | Rohr . |
| 5,133,486 | 7/1992 | Moore et al. . |
| 5,255,812 | 10/1993 | Hau . |
| 5,271,531 | 12/1993 | Rohr et al. . |
| 5,292,025 | 3/1994 | Dubreul . |
| 5,356,018 | 10/1994 | Dubach . |
| 5,386,918 | 2/1995 | Neveras et al. . |
| 5,400,912 | 3/1995 | Brown et al. . |
| 5,427,260 | 6/1995 | Mueller et al. . |
| 5,437,382 | 8/1995 | Gluckman . |
| 5,439,124 | 8/1995 | Mock . |
| 5,439,143 | 8/1995 | Brown . |
| 5,462,200 | 10/1995 | Weiler . |
| 5,469,980 | 11/1995 | O'Meara . |
| 5,482,176 | 1/1996 | Maietta . |
| 5,501,348 | 3/1996 | Takeuchi . |
| 5,503,282 | 4/1996 | Montgomery . |
| 5,505,326 | 4/1996 | Junko . |
| 5,547,091 | 8/1996 | Neveras et al. . |
| 5,566,859 | 10/1996 | Willis et al. . |
| 5,642,824 | 7/1997 | Hess, III et al. . |
| 5,711,453 | 1/1998 | Weiler . |
| 5,992,668 | 12/1997 | Elliott ..... 220/278 |

OTHER PUBLICATIONS

"Molding Many Parts Into One," Product Design and Development, Dec. 19, 1995, p. 16 (Author: Jay Rosenberg).

A copy of 2 photographs of a closure specimen, one photograph showing a top perspective view with the closure open, and the other photograph showing a bottom perspective view with the closure open.

SEALED DISPENSING CLOSURE WITH A SEAL PENETRATOR

CROSS-REFERENCE TO RELATED APPLICATION

This is a continuation of U.S. patent application Ser. No. 09/001,151, filed Dec. 30, 1997, now U.S. Pat. No. 5,992,668, which is a continuation-in-part of U.S. patent application Ser. No. 08/680,252, filed Jul. 11, 1996, now abandoned.

TECHNICAL FIELD

This invention relates to container closures. The invention is more particularly related to a sealed, tamper-indicating, dispensing closure for use with a squeeze-type container wherein a product can be discharged from the container through the opened dispensing closure when the container is squeezed.

BACKGROUND OF THE INVENTION AND TECHNICAL PROBLEMS POSED BY THE PRIOR ART

Various product packaging designs employ barriers or seals across an opening to the package. Such seals can serve as a primary or secondary barrier against contaminant ingress. Such seals may also maintain product freshness. In addition, such seals may provide a tamper-indicating function wherein breaking or removing the seal provides evidence that the package has been opened.

An example of a closure with an internal tamper-indicating seal is disclosed in U.S. Pat. No. 4,948,003. The closure includes a base for mounting the closure to the container. The base includes a pour spout. The interior of the pour spout is initially occluded by a sealing disk which is molded as unitary part of the pour spout. The periphery of the sealing disk defines a reduced cross-sectional thickness of material which functions as a frangible web connecting the sealing disk to the pour spout. The upper (outwardly facing) surface of the sealing disk includes a pull tab which is grasped by a user's fingers for ripping the sealing disk out of the pour spout. The closure also includes a hinged lid with an internal collar to telescopically receive the pour spout in sealing engagement when the lid is closed so as to provide a liquid-tight and air-tight system after the sealing disk has been removed.

While closures of the above-discussed type function generally satisfactorily in applications for which they are intended, it would desirable to provide an improved closure which could be employed in a variety of other applications in which the above-discussed closure is not suitable. For example, in some applications it might be desirable to provide a relatively small diameter pour spout. Access to a sealing disk disposed in such a small-diameter pour spout would be difficult. It may be difficult or impossible to provide a pull tab arrangement within such a small-diameter spout that could be easily grasped by the user.

Further, it may be desirable to provide a closure base molded from a particular material having certain desirable characteristics (e.g., strength, greater hardness, etc.). However, such characteristics may not be compatible with the desired operation of a unitary molded sealing member. That is, some materials that would be useful for an exterior closure body may not have characteristics that accommodate relatively easy tearing for seal removal. Further, while some materials may have strength or hardness characteristics desirable for a closure body, such materials may not be as compatible with the container product as would be desired. Also, a strong closure body material might have undesirably high gas permeability characteristics that would reduce the effectiveness of the material as a seal.

Accordingly, it would be desirable to provide an improved closure for accommodating the use of a small dispensing orifice or spout as well as a large dispensing orifice or spout wherein an internal seal could be readily opened by the user.

Such an improved closure should advantageously provide a tamper-indicating means for visually indicating that the seal has been opened.

It would also be beneficial if such an improved closure could accommodate the use of a variety of seal materials in conjunction with a variety of different closure body materials.

It would also be desirable to provide such an improved closure with a design that could accommodate storage of the container and closure in an inverted (upside down) position wherein the closure supports the container. This would be especially useful for maintaining the fluid product in contact with the dispensing orifice so that, upon opening the closure, the product could be readily discharged without having to wait for the fluid product to flow down toward the dispensing orifice.

Also, it would be desirable if such an improved closure could be provided with a design that would accommodate efficient, high quality, large volume manufacturing techniques with a reduced product reject rate.

Further, such an improved closure should advantageously accommodate its use with a variety of conventional containers having a variety of conventional container finishes, such as conventional threaded or snap-fit attachment configurations.

The present invention provides an improved closure which can accommodate designs having the above-discussed benefits and features.

SUMMARY OF THE INVENTION

According to the present invention, an improved dispensing closure is provided for an opening to a container interior. The closure can be provided with a very small dispensing orifice or with a large dispensing orifice. The closure includes a tamper-indicating seal and lid-actuated opening system. The closure is easily manipulated by the user to open the seal, and once the seal is opened, the configuration of the lid indicates that the closure seal has been initially opened. An optional re-sealing collar can be provided on the lid for resealing the opening.

The closure has a base including a body for mounting to the container around the opening. The base body defines a dispensing orifice for communicating with the container opening. The base includes a tamper-evident seal extending across the dispensing orifice. One aspect of the improved closure permits one material to be used for the closure body and a different material to be used for the closure seal.

The closure includes a lid for occluding the dispensing orifice in a closed position over the base body and for being moved away from the closed position to permit the dispensing of container-stored contents out of the orifice. According to one aspect of the invention, the lid includes (a) a peripheral frame, and (b) a flexible panel or dome that (1) is connected to the frame with a hinge, (2) is normally biased to an outwardly convex configuration, and (3) accommodates flexure of the panel or dome to an inverted inwardly concave configuration. The lid also includes a penetrator member which extends from the panel or dome for penetrating the seal when the panel is in the inwardly concave configuration.

In accordance with another aspect of the present invention, the base can be molded from at least a first material which defines at least a portion of a tamper-evident seal that is unitary with the base body and that extends across the dispensing orifice. The lid includes (a) a peripheral frame, (b) a flexible panel that is connected with the frame and that is normally biased to an outwardly convex configuration as viewed from outside the lid, (c) only one reduced thickness, film hinge joining the periphery of the flexible panel to the lid peripheral frame for accommodating flexure of the flexible panel to a self-maintained, inverted, inwardly concave configuration, and (d) a penetrator member extending from the flexible panel for penetrating the seal when the flexible panel is in the inwardly concave configuration.

According to yet another aspect of the invention, the closure base can be coinjection molded from first and second materials and is adapted to be mounted to a container around the container opening. The base has an exterior and an interior. The first material defines the exterior. The second material is encapsulated in the first material as a core. The base defines a dispensing orifice for communicating with the container opening. The base includes a tamper-evident seal that is unitary with the first and second materials and that extends across the dispensing orifice. The closure also includes a lid which includes (a) a peripheral frame, (b) a flexible panel that connected to the frame and that is normally biased to an outwardly convex configuration as viewed from outside the lid, (c) at least one hinge connecting the flexible panel to the frame for accommodating flexure of the flexible panel to an inverted inwardly concave configuration, and (d) a penetrator spike extending from the flexible panel for penetrating the seal when the flexible panel is in the inwardly concave configuration.

In a preferred embodiment, the closure also includes a hinge connecting the lid to the body to accommodate movement between a closed position covering the body and an open position in which the body is uncovered.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
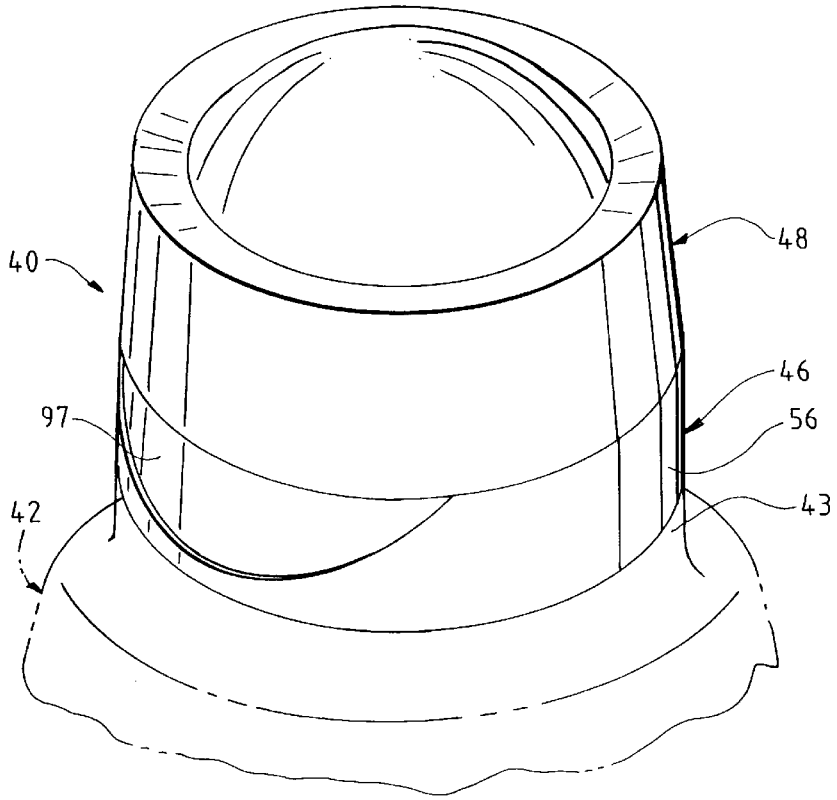
FIG. 1 is a fragmentary, perspective view of a first embodiment of a closure of the present invention shown in place on a container.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure components of this invention are described in various positions, and terms such as upper, lower, horizontal, etc., are used with reference to these positions. It will be understood, however, that the closure components may be manufactured and stored in orientations other than the ones described.

With reference to the figures, a first embodiment of a closure of the present invention is illustrated in FIGS. 1–4 and is represented generally in the figures by reference numeral 40. The closure 40 is adapted to be disposed on a container, such as a container 42 (FIG. 1) which has a conventional mouth or opening (not visible) formed by a neck 43 (FIG. 1) or other suitable structure. The neck 43 typically has (but need not have) a circular cross-sectional configuration, and the body of the container 42 may have another cross-sectional configuration, such as an oval cross-sectional shape, for example.

The container 42 may be stored and used in the orientation shown in FIG. 1 wherein the closure 40 is at the top of the container 42. The container 42 may also be normally stored in an inverted position (not illustrated) once the internal seal has been opened as explained in detail hereinafter. When stored in the inverted position, the container 42 employs the closure 40 as a support base.

The container 42 is a squeezable container having a flexible wall or walls which can be grasped by the user and compressed to increase the internal pressure within the container so as to squeeze the product out of the container through the closure (after the closure is opened as explained in detail hereinafter). The container wall typically has sufficient, inherent resiliency so that when the squeezing forces are removed, the container wall returns to its normal, unstressed shape.

Figure 2:
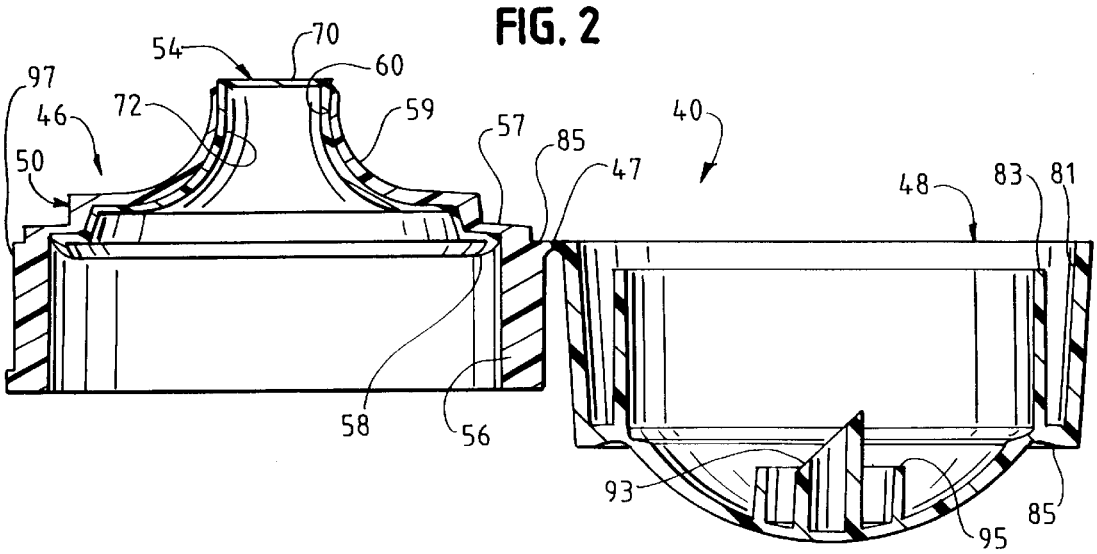
FIG. 2 is a cross-sectional view of the closure showing the lid removed from the base.

The closure 40 may be fabricated from a synthetic, thermoplastic, polymer material, or other materials, compatible with the container contents. The closure 40 includes a base 46 and a lid 48. The base 46 includes a body 50 and a seal 54 (FIG. 2). In the first embodiment illustrated in FIGS. 1–4, the body 50 includes an annular wall 56 which may have suitable connecting means (e.g., a conventional thread or conventional snap-fit bead (not illustrated)) for engaging suitable cooperating means, such as a thread or bead on the container neck 43 (not visible) to secure the closure base 46 to the container 42. The closure base body 50 and container 42 could also be welded together by induction melting or ultrasonic melting.

Near the top of the annular wall 56, the closure body 50 has an annular deck 57 (FIG. 2) which extends over the upper, distal end of the container neck 43. Preferably, a downwardly extending, annular, flexible seal 58 (FIG. 2) projects downwardly below the deck 57 and is received against the upper edge of the container neck 43 adjacent the container neck opening so as to provide a leak-tight seal between the closure body deck 57 and the container neck 43. Of course, other types of closure body/container seals (e.g., flat) may be employed. Also, if air-tightness is not required, no closure body/container seal need be employed.

As illustrated in FIGS. 1 and 2, the closure body 50 includes an upwardly projecting discharge spout 59 defining a discharge aperture or dispensing orifice 60 over the container neck opening.

The base seal 54 is typically a layer, film, or membrane of material which is different than the material from which the body 50 is made. The seal 54 includes a generally disk-like central portion 70 occluding the dispensing orifice 60 of the closure base body spout 59 and includes a downwardly extending peripheral portion 72 adjacent the interior surface of the spout 59 and annular deck 57. In the embodiment illustrated in FIGS. 1–4, the seal 54 extends along the inside surface of the spout 59 and under the annular deck 57 to define the flexible member 58 which seals against the top of the container neck. The seal 54 may be secured to the interior surface of the closure body 50 by any suitable conventional or special means. These could include, for example, mechanical interlock structures, adhesives, heat seal welds, etc.

In a preferred embodiment, the closure base body 50 is molded from a first material, such as polypropylene, and the seal 54 is molded from a second material, such as polyethylene. Preferably, a conventional multi-shot injection molding process is used to first mold the closure base body 50 as a "preform" in a first injection phase in a mold. The preform of the closure base body 50 is then automatically transferred to a second, differently shaped cavity in the same mold wherein the second material (e.g., polyethylene) is injection molded or over-molded in a second phase onto and against portions of the closure base body or preform. Conventional multi-shot, multi-material injection molding of a closure is disclosed in the U.S. Pat. No. 5,439,124. Other descriptions of such processes are set forth in "Multi-Material Injection Saves Time, While Cutting Costs," MODERN PLASTICS, Mar. 19, 1994 (author: Peter Mapleston) and in "Molding Many Parts Into One," Product Design and Development, Dec. 19, 1995, page 16 (author: Jay Rosenberg).

The use of polyethylene for injection molding the seal 54 is advantageous in many applications because polyethylene provides a relatively good oxygen barrier which prevents oxygen migration through the seal into the container. This is especially useful for closures on containers containing food. Additionally, polyethylene provides the desired characteristics that accommodate opening of the seal 54 as described in detail hereinafter.

In an alternative manufacturing process, the layer or membrane of the seal 54 may be molded completely separately from the closure base body 50 and subsequently inserted into the closure base body 50 for retention therein by suitable means. This could include induction heat welding, gluing, compressive insertion, or snap-on retention features.

Figure 3:
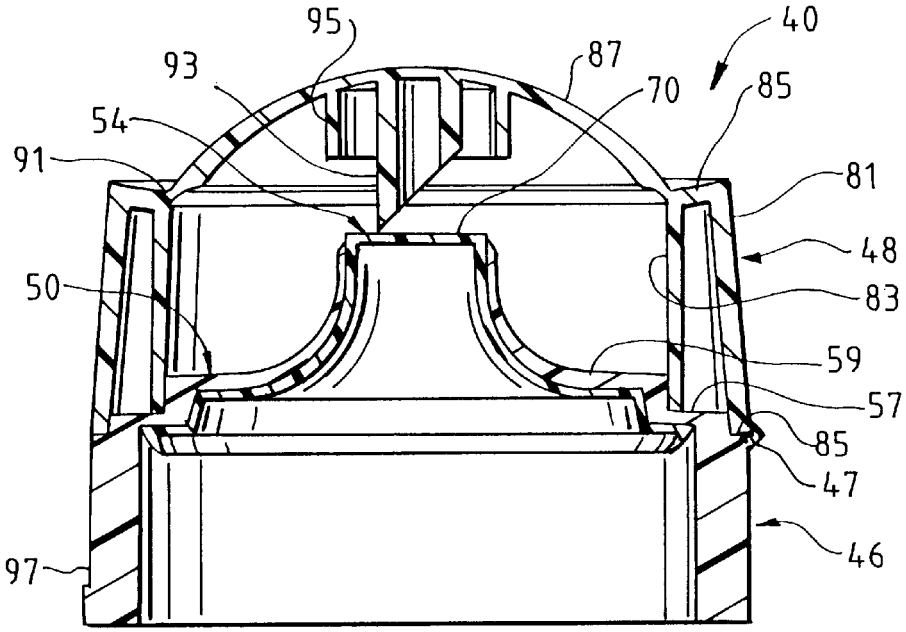
FIG. 3 is a cross-sectional view of the closure with the lid in place on the closure base prior to penetrating the closure base seal.

The closure lid 48 is adapted to be initially mounted on the closure base 46 as illustrated in FIG. 3. The lid 48 may be an entirely separate piece unconnected to the closure base 46. Alternatively, a hinge 47 (FIG. 2) may be provided for connecting the lid 48 to the base 46. The hinge may be a floppy hinge or a snap-action hinge.

The lid 48 includes a peripheral frame comprising an outer wall 81, an inner wall 83, and an annular connecting wall 85 (FIG. 3). As illustrated in FIG. 3, the lid outer wall 81 is adapted to seat on an annular shoulder 85 defined at the top of the closure base body sidewall 56. The lid inner wall 83 is designed to be located on top of the closure base body annular deck 57 around the base of the spout 59.

The lid 48 includes a flexible panel 87 which preferably defines a dome. The panel 87 is sufficiently flexible that it can be moved downwardly when a force is applied to the top outer surface of the panel 87 as indicated by the arrow 89 in FIG. 4.

Figure 4:
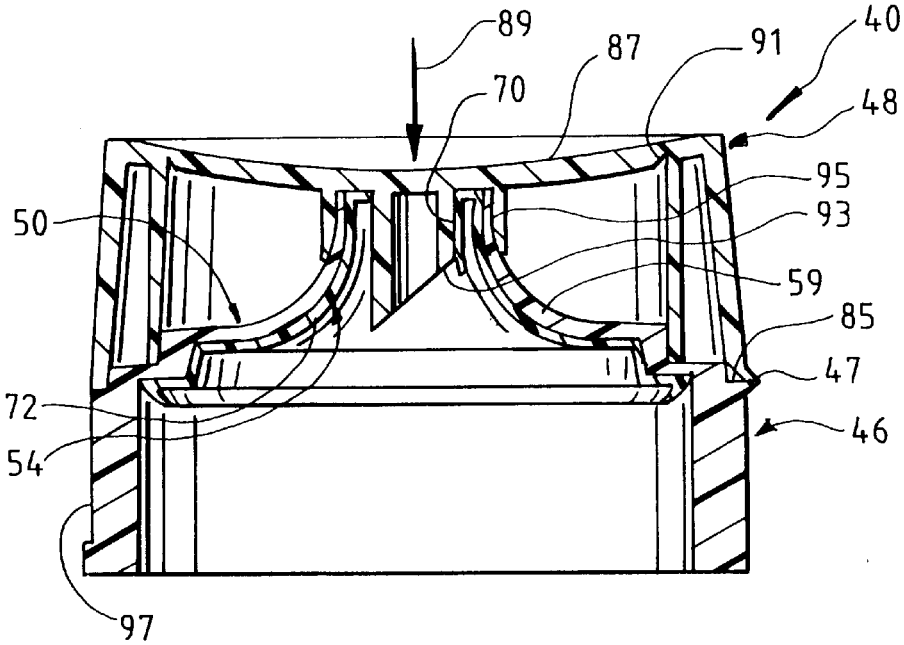
FIG. 4 is a view similar to FIG. 3, but FIG. 4 shows the lid deformed to an inverted, inwardly concave configuration in which the base seal is pierced.

A presently preferred system for providing sufficient flexibility in the panel 87 includes connecting the panel 87 to the annular connecting wall 85 with a generally annular, reduced thickness film hinge 91 (FIG. 3). This readily accommodates movement of the panel 87 from an outwardly convex configuration (as viewed from outside the lid) as shown in FIG. 3 to an inverted, inwardly concave configuration (as viewed from outside the lid), as shown in FIG. 4.

The lid 48 includes a penetrator member 93 extending inwardly from the panel 87. Preferably, the penetrator member 93 is a tubular spike having a pointed end for piercing the central disk 70 of the membrane or seal 54.

An annular sealing collar 95 extends from the panel 87. The collar 95 is spaced radially from the penetrator member 93 for sealingly engaging the spout 59 when the panel 87 is in the inwardly concave configuration (FIG. 4).

The closure 40 having the configuration shown in FIG. 3 is initially mounted on the container 42 prior to delivery of the package to the user. The outwardly convex configuration of the lid indicates that the seal has not been punctured. A user may confirm this by removing the lid 81 to observe that the seal 54 is intact.

When the user desires to open the closure 40 to dispense product from the container, the user pushes down on the top surface of the panel 87 so that the penetrator member 93 pierces the central portion 70 of the seal 54. This action may be characterized as "opening" the seal 54 while at the same time "sealing" the spout 59 (by virtue of the engagement of the collar 95 with the exterior surface of the spout 59).

The panel 87 remains in the inverted, inwardly concave position to form a dished top. The container with the closure mounted thereon may then be turned upside down so that the container and closure can be supported upside down on a support surface. This will enable the product within the container to flow down to the region of the spout under the influence of gravity so that the product can be readily discharged from the container when the lid is later removed prior to use.

The panel 87 has two stable positions, the outwardly convex position illustrated in FIG. 3 and the inwardly concave position illustrated in FIG. 4. At any position between the two stable positions, the panel 87 is in compression and exhibits a resistance to movement between the two stable positions. The degree of resistance to movement may be defined, at least in part, by the differential surface areas of the panel 87 and planar area defined by the film hinge 91. As the panel 87 is pushed from one stable position to the other stable position, the resistance to movement is overcome by resilient compressive bowing and distortion which is accommodated by the resilient material of the lid (which may be polypropylene, for example) and by the film hinge 91.

When the user desires to dispense product from the container 42 through the closure, the user lifts the lid 48 away from the spout 59. Preferably, the closure base body 50 defines a recess 97 in a portion of the body wall 56 as illustrated in FIGS. 1–4. The user can move a thumb or finger upwardly along the recess 97 to engage a bottom edge of the lid 48 and lift it upwardly away from the spout 59.

As the lid 48 moves upwardly, the friction created between the lid collar 95 and spout 59 exerts a downwardly or inwardly directed force on the collar 95 and panel 87. This force insures that the panel 87 remains in the inwardly concave configuration as the lid 48 is lifted upwardly.

When the lid is moved far enough away from the spout 59, the product may be discharged from the container through the spout 59 by squeezing the container. When it is again desired to close the container, the lid 48 is pushed back onto the base 46 by pushing downwardly on the panel 87. The force exerted downwardly on the panel 87 (in the direction of the arrow 89 as illustrated in FIG. 4) prevents the panel 87 from inverting to an outwardly convex configuration and is effective in sealing the components in the closed configuration illustrated in FIG. 4. The inwardly concave configuration of the lid indicates that the seal has been punctured.

Figure 5:
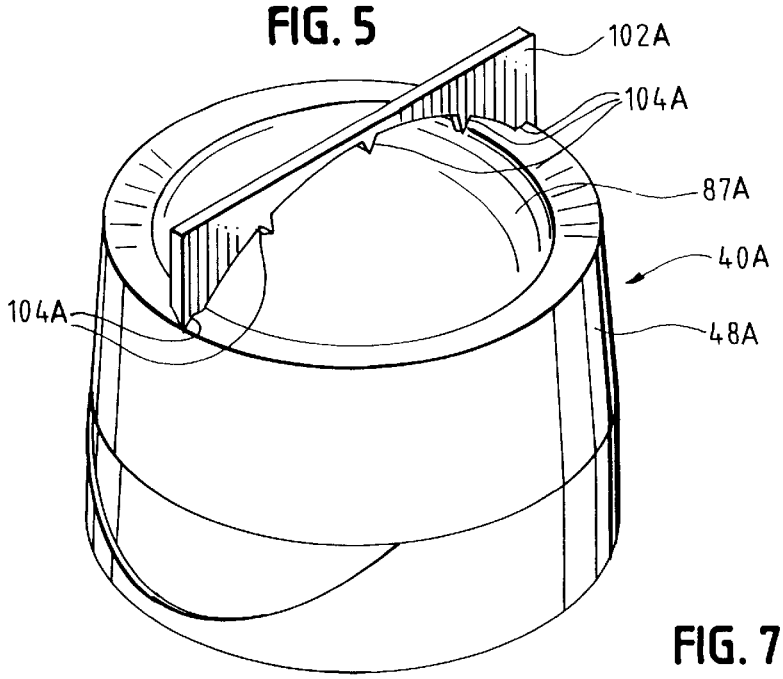
FIG. 5 is a view similar to FIG. 1, but FIG. 5 shows a second embodiment of the closure.

FIG. 5 illustrates a second embodiment of the closure 40A having a lid 48A with a dome 87A initially in the upwardly convex configuration. During shipping and storage of the closure before and/or after being mounted on the container, it may be desirable to prevent or minimize the possibility of the panel 87A being accidentally deflected inwardly whereby the seal (e.g., the seal 70 illustrated in FIG. 3) would be prematurely punctured. To this end, the closure 40A includes an impact-resisting guard bridge 102A. The bridge 102A extends over the panel 87A and is connected to the panel 87A with frangible joints 104A and is also connected with frangible joints to the closure lid 48A radially outwardly of the panel 87A. During shipping and handling, if the closure 40A is moved against another object, or if another object is moved against the closure 40A, the bridge 102A minimizes the likelihood that the panel 87A will be deflected inwardly. When it is desired to use the closure, the user first breaks the bridge 102A away from the closure lid 48A at the frangible connections 104A.

Figure 6:
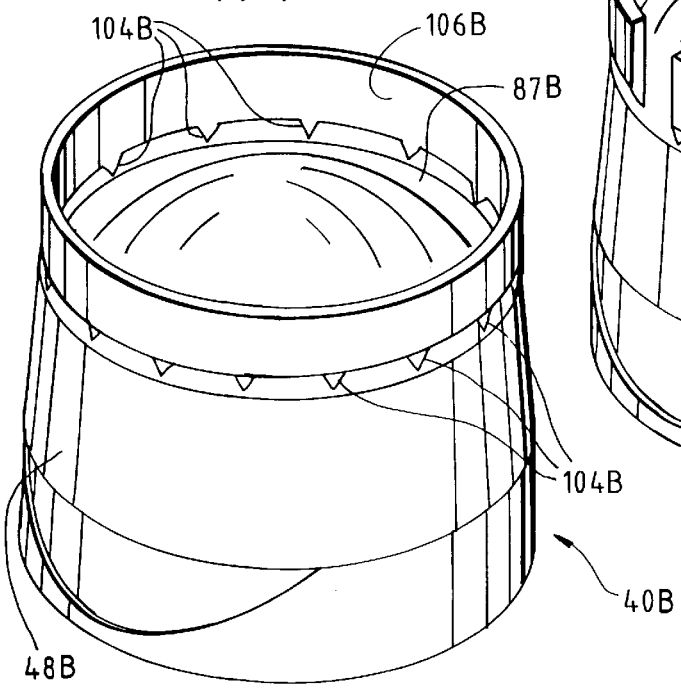
FIG. 6 is a view similar to FIG. 1, but FIG. 6 shows a third embodiment of the closure.

FIG. 6 illustrates a third embodiment of a closure 40B having a panel 87B which is protected by an annular ring 106B. The ring 106B is attached with frangible connections 104B to the closure lid 48B and minimizes the likelihood that the panel 87B will be deflected inwardly until the user tears away the ring 106B. When it is desired to open the second embodiment of the closure 40B, the ring 106B is first broken away from the lid 48B. Then the panel 87B can be pushed downwardly to pierce the seal (such as the seal 70 of the first embodiment of the closure 40 illustrated in FIG. 3).

Figure 7:
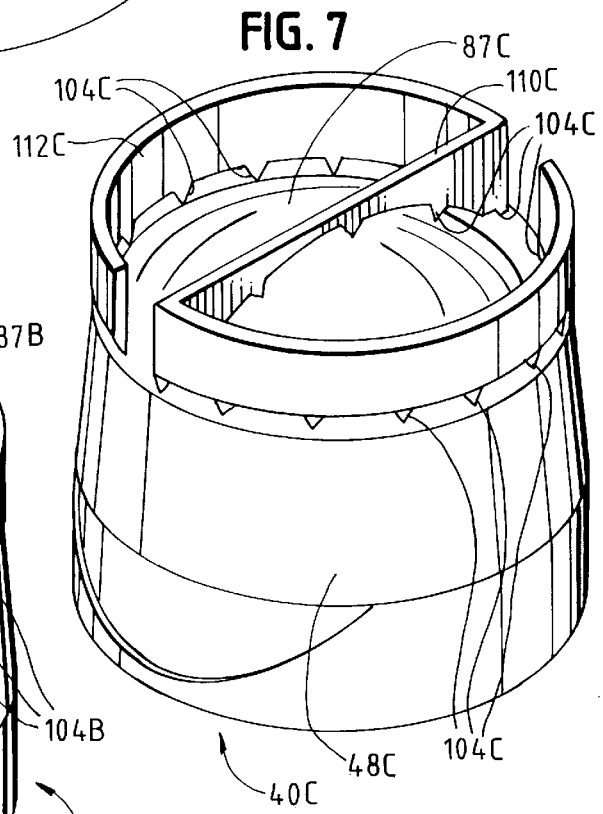
FIG. 7 is a view similar to FIG. 1, but FIG. 7 shows a fourth embodiment of the closure.

A fourth embodiment of the closure is designated generally by the number 40C in FIG. 7 and includes a bridge portion 110C and two partially cylindrical wall portions 112C. The bridge portion 110C extends over, and has frangible connections 104C to, the panel 87C in substantially the same manner as the bridge 102A discussed above with reference to the second embodiment of the closure 40A illustrated in FIG. 5. Each end of the bridge portion 110C also has frangible connections 104C to the closure lid 48C outwardly of the panel 87C. Each vertical end of the bridge portion 110C is also connected to one of the partially cylindrical wall portions 112C. Each wall portion 112C is attached with frangible connections 104C to the periphery of the lid 48C outwardly of the panel 87C.

The bridge portion 110C and wall portions 112C provide a more impact-resistant guard structure around the panel 87C than does the bridge 102A alone as employed in the second embodiment of the closure 40A illustrated in FIG. 5 or the ring 106B as employed in the third embodiment of the closure 40B illustrated in FIG. 6.

When it is desired to open the closure 40C, the guard bridge portion 110C and wall portions 112C are first broken away form the top of the lid 48C. Thereafter, the central panel 87B can be pushed downwardly to pierce the seal.

Figure 8:
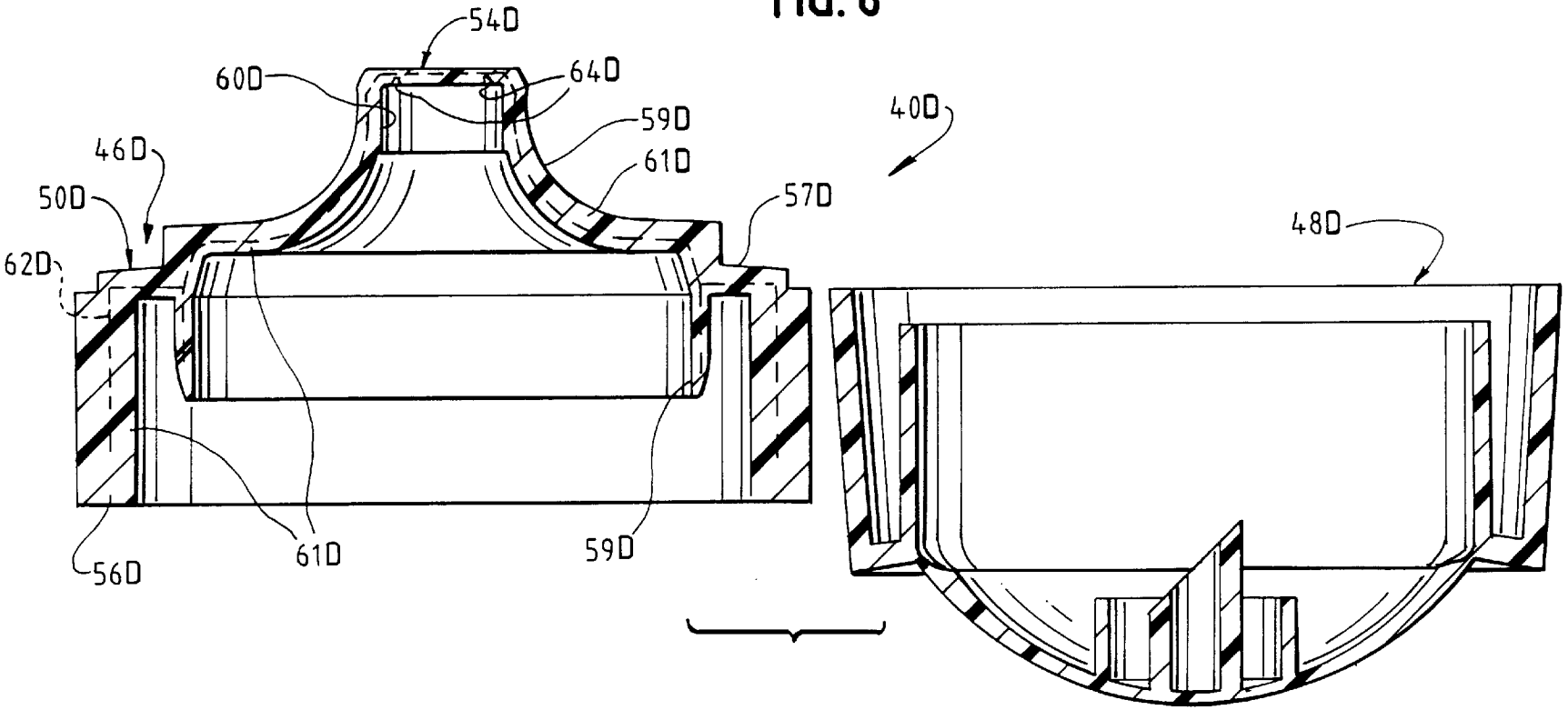
FIG. 8 is a cross-sectional view of a fifth embodiment of the closure showing the lid removed from the base.
Figure 9:
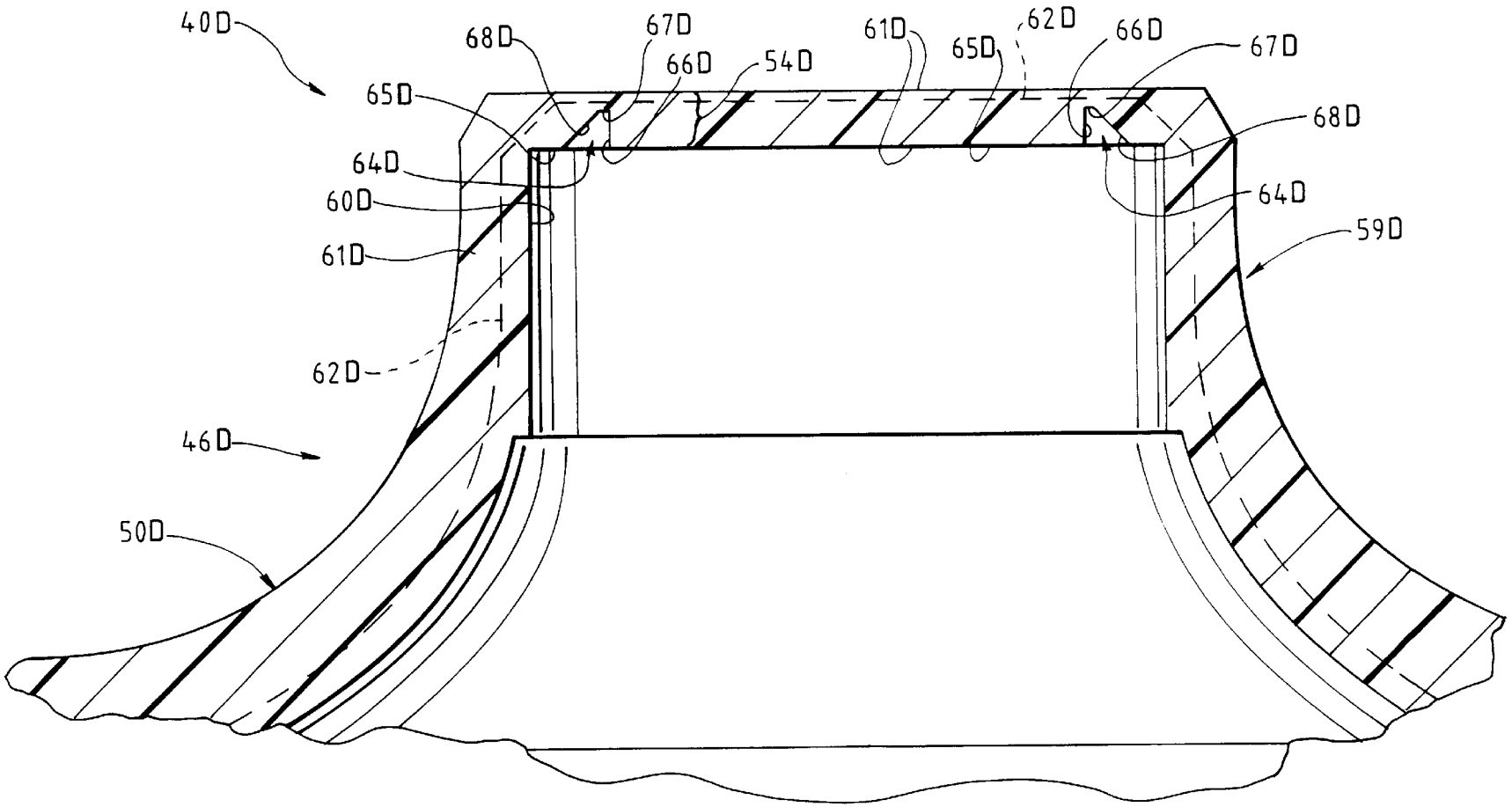
FIG. 9 is a greatly enlarged, fragmentary, cross-sectional view of the spout portion of the base of the fifth embodiment of the closure shown in FIG. 8.

A fifth embodiment of the closure of the present invention is designated generally by the number 40D in FIGS. 8 and 9. The closure 40D includes a base 46D and a lid 48D. The structure of the lid 48D is identical with the structure of the lid 48 of the first embodiment of the closure 40 described above in detail with reference to FIGS. 1–4. However, unlike in the first embodiment illustrated in FIGS. 1–4, the fifth embodiment closure lid 48D and closure base 46D are not connected with a hinge. Nevertheless, in a particular application, the lid 48D and base 46D may, of course, be connected with a suitable hinge. One suitable hinge is the type of hinge designated with the reference number 47 in FIG. 2 as employed in the first embodiment of the closure.

The base 46D includes a body 50D with an annular wall 56D which may have a suitable connecting means (e.g., a conventional thread or a conventional snap-fit bead (not illustrated)) for engaging a suitable cooperating means, such as a thread or bead on the container neck (not visible) to secure the closure base 46D to the container. Such structures, and other structures for mounting the closure base body to a container, are described above in more detail with respect to the first embodiment of the closure illustrated in FIGS. 1–4.

The closure body 50D has an annular deck 57D which is adapted to extend over the upper, distal end of the container neck (not illustrated). Preferably, an annular, somewhat flexible, plug seal 58D projects downwardly below the deck 57D and is received inside the upper edge of the neck of the container to which the closure base 46D is mounted so as to provide a leak-tight seal between the closure base body 50D and the neck of the container. Of course, other types of closure body/container seals may be employed. For example, the closure base body 50D may be provided with a small, flexible seal of the type used in the first embodiment of the closure and which is designated by the reference number 58 in FIG. 2. Of course, if air-tightness is not required, no closure body/container seal need be employed.

The closure body 50D includes an upwardly projecting discharge spout 59D defining a discharge aperture or dispensing orifice 60D over the container neck opening.

The base 46D may be characterized as having an exterior and an interior. The exterior is that portion of the closure base 46D which is exposed when the closure is mounted on a container. The interior of the closure base 46D is that portion of the base 46D which would be inside the closure base 46D and not readily visible when the closure base 46D is viewed from the outside while mounted on a container.

The closure base includes a first material, or skin material 61D, defining the exterior and interior, and a second material, or core material 62D, which is encapsulated by the first material 61D. For ease of illustration, the second material 62D is shown by a dashed line representing a relatively thin portion of the second material 62D compared to the thickness of the first material 61D.

The first material 61D and second material 62D extend across the dispensing orifice 60D to define a tamper-evident seal 54D (FIG. 9). In the preferred embodiment illustrated in FIGS. 8 and 9, the closure base 46D includes an annular groove 64D which is molded in the first material 61D at the periphery of the seal 54D to define a reduced thickness, frangible portion of the first material 61D. The groove 64D is defined in an inwardly or downwardly facing surface 65D on the bottom of the seal 54D. The groove 64D is more particularly defined by three other surfaces: (1) a cylindrical surface 66D extending into the first material 61D from the inwardly facing surface 65D, (2) a radially oriented annular surface 67D which extends from the cylindrical surface 66D, and (3) a frustoconical surface 68D extending from the annular surface 67D to the inwardly facing surface 65D.

In the preferred embodiment, the first material 61D and second material 62D are coinjection molded by conventional techniques, the details of which form no part of the present invention. Coinjection molding is a convenient manufacturing technique that results in the two materials 61D and 62D being in intimate contact and forming a substantially unitary structure.

The use of the second material 61D throughout the closure base 46D provides certain advantages. For example, the second material 62D may be a material that has good barrier characteristics with respect to preventing the permeation or migration of various gases, such as oxygen, which could deleteriously affect a food product or pharmaceutical product over an extended period of time. The first material 61D need not have very good barrier characteristics, but could typically have much better characteristics with respect to strength, surface finish, aesthetic appearance, scratch resistance, etc. Any suitable material may be used for the first material 61D, including, but not limited to, polypropylene or polyethylene. The second material 62D may be any suitable barrier material, such as, but not limited to, polyethylene naphthalate, ethylene vinyl alcohol, or Barex-210. Barrier materials, especially materials providing good barrier properties with respect to oxygen, are well-known.

In a presently contemplated preferred embodiment, a closure base 46D is coinjection molded from the first and second materials so that the thickness for the second material 62D in the seal 54D (FIG. 9) is between about 0.001 inch and about 0.005 inch. In the region over the annular groove 64D, the first material 61D may have an exterior thickness (on the exterior of the first material 62D) ranging between about 0.015 inch and about 0.002 inch. On the interior of the second material 62D, between the second material 62D and the top of the annular groove 64D defined by the groove annular surface 67D, the first material 61D may have a thickness ranging between about 0.002 inch and about 0.005 inch. In the portions of the base 46D outwardly of the seal 54D (e.g., in the walls of the spout 59D, in the deck 57D, and in the skirt 56D, the core material or second material 62D may have a thickness up to about 0.05 inch.

The above-described material thicknesses are applicable to a presently contemplated preferred embodiment for a particular closure application. It will be appreciated that the first and second materials may have other thicknesses in other closure designs and/or for other applications. Further, it will be appreciated that the particular thicknesses of the first and second materials may depend, to some extent, upon the properties of the particular materials employed. For example, a material with very high barrier characteristics may be included in a closure base in only a very thin layer. A material with barrier properties that are not as great would require a thicker layer of such a material.

The annular groove 64D aids in penetration of the seal 54D when the lid 48D is mounted over the closure base 46D and actuated to penetrate the seal 54D. In this respect, the lid 48D functions in the same manner as the lid 48 described above with reference to the first embodiment illustrated in FIGS. 1–4. The annular groove 64D in the fifth embodiment illustrated in FIGS. 8–9 serves to reduce the thickness of the first material 61D at the periphery of the seal 54D. Thus, when the lid 48D is actuated to penetrate the seal 54D, the seal can more easily break about its periphery at the groove 64D. The groove 64D may be a completely circular groove or may extend around only a portion of the seal 54D (e.g., for about 330°).

Figure 10:
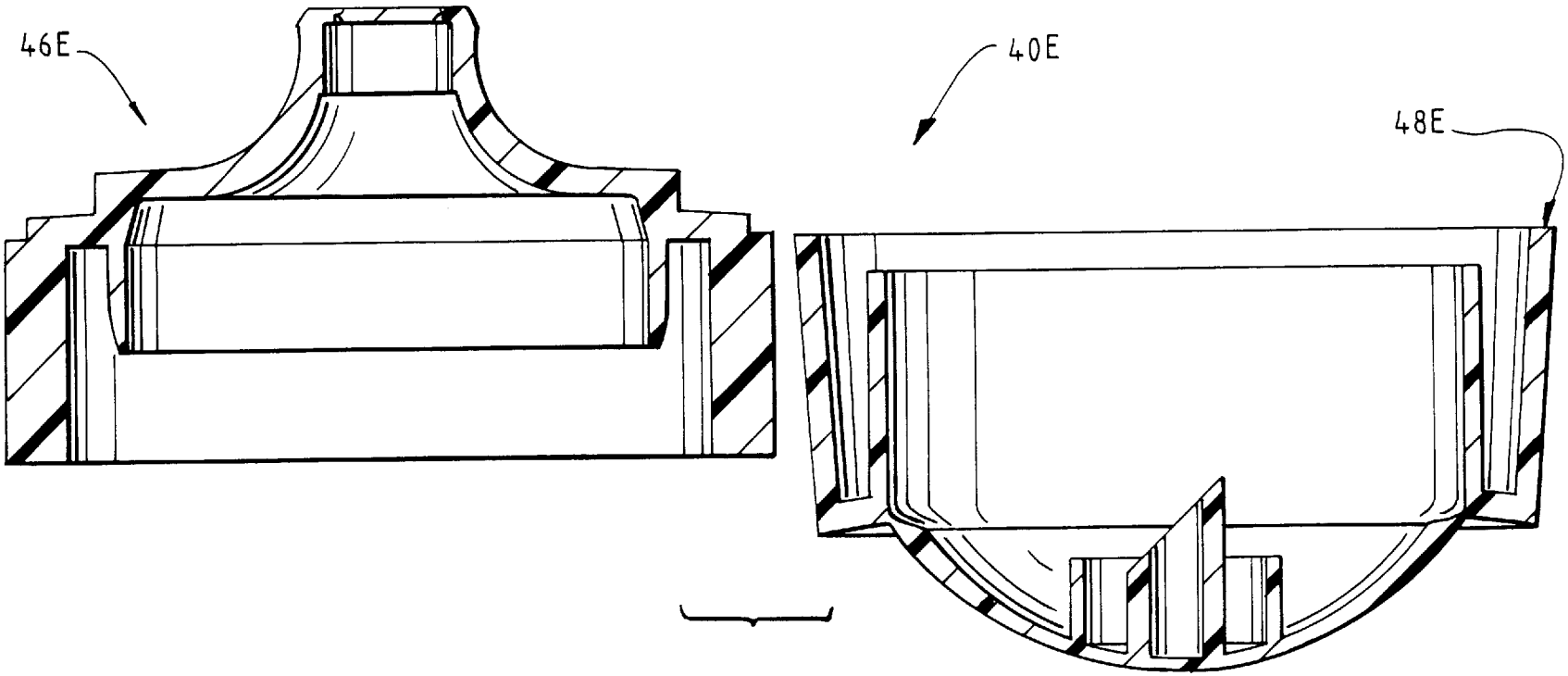
FIG. 10 is a cross-sectional view of a sixth embodiment of the closure showing the lid removed from the base.
Figure 11:
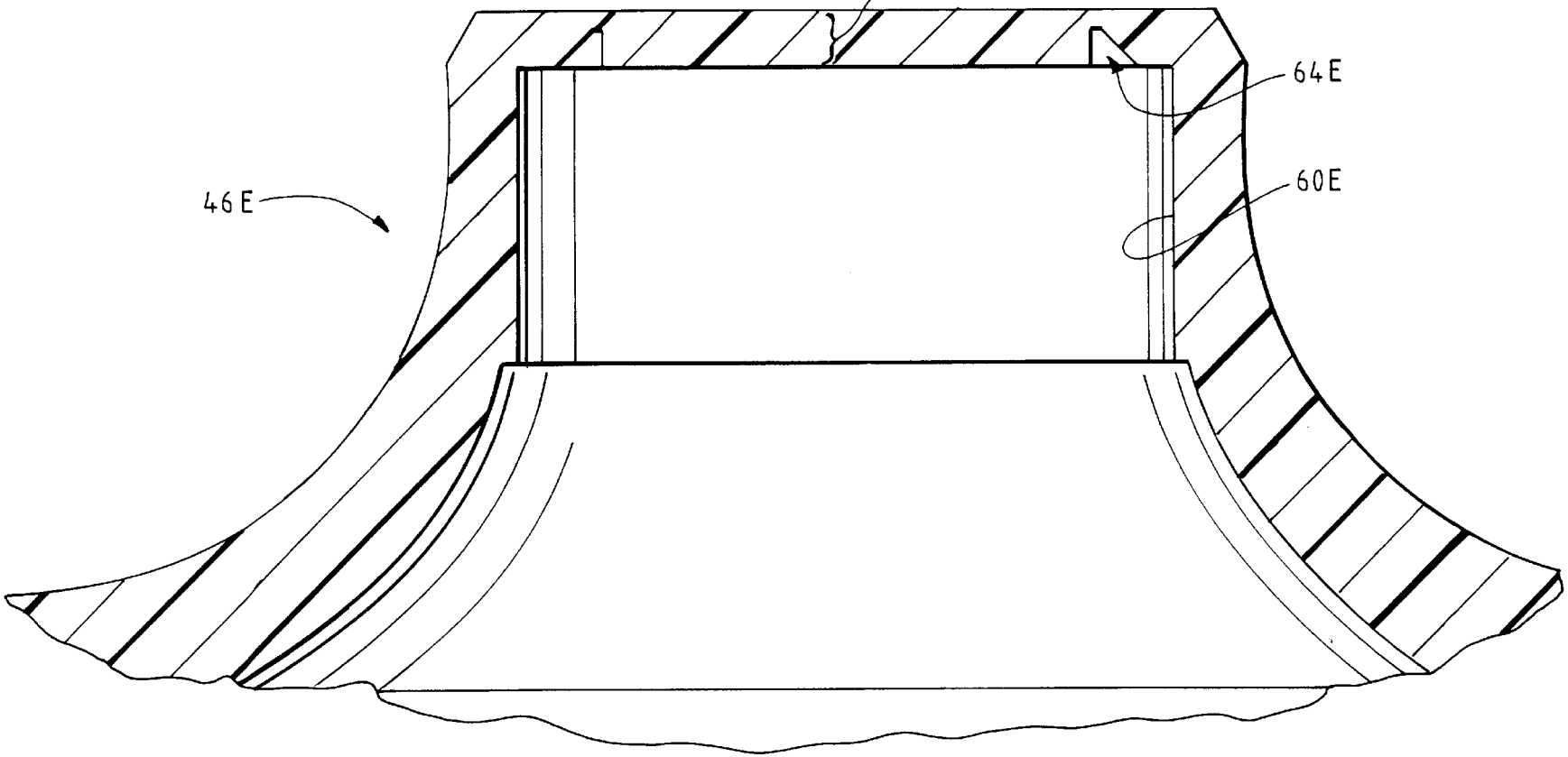
FIG. 11 is a greatly enlarged, fragmentary, cross-sectional view of a portion of the spout of the base of the sixth embodiment of the closure shown in FIG. 10.

FIGS. 10 and 11 illustrate a sixth embodiment of the closure of the present invention, and the closure is designated in FIGS. 10 and 11 generally by the reference number 40E. The closure 40E includes a base 46E and a lid 48E. The lid 48E has the same structure as, and operates in the same manner as, the lid 48D of the fifth embodiment described above with reference to FIGS. 8 and 9. As with the fifth embodiment of the closure 40D described above with reference to FIGS. 8–9, the sixth embodiment closure lid 48E and base 46E are not hinged together. However, a suitable hinge structure may be provided if desired.

The sixth embodiment closure base 46E has the same geometric configuration as the closure base 46D of the fifth embodiment described above with reference to FIGS. 8 and 9. The sixth embodiment closure base 46E differs only in that the sixth embodiment base closure 46E is molded from a single material rather than coinjection molded from two materials as in the fifth embodiment of the closure 46D. The sixth embodiment closure base 46E may be characterized as including a body that is molded from at least a first material.

The base first material may be characterized as defining at least a portion of a tamper-evident seal 54E which is unitary with the closure base and extends across a dispensing orifice 60E. An annular groove 64E is molded in the first material at the periphery of the seal 54E to define a reduced thickness, frangible portion of the first material. The configuration of the annular groove 64E is identical with the configuration of the fifth embodiment closure annular groove 64D described in detail above with reference to FIGS. 8 and 9.

In a preferred form of the sixth embodiment of the closure 40E, the closure 40E is molded from a single material such as polypropylene or polyethylene, such as may be used for the first material 61D in the fifth embodiment of the closure 40D described above with reference to FIGS. 8 and 9. Although the preferred form of the sixth embodiment of the closure base 46E does not include a second material, the seal 54E and annular groove 64E function in a manner that is analogous to the seal 54D and groove 64D in the fifth embodiment described with reference to FIGS. 8 and 9 except that the sixth embodiment does not possess whatever barrier characteristics and other characteristics are provided by a second, core material, such as the second material 62D described above with reference to the fifth embodiment illustrated in FIGS. 8 and 9.

It will be appreciated, however, that the sixth embodiment of the closure 40E could instead be molded from a single material that is identical with the second material 62D described above with reference to the fifth embodiment illustrated in FIGS. 8 and 9. If the second material 62D is used in the sixth embodiment of the closure base 46E as the sole material, then the sixth embodiment of the closure base 46E would have such barrier characteristics and other characteristics as would result from the use of such a material.

With the closure of the present invention, a user can readily ascertain whether or not the closure seal has been punctured. The user need merely observe whether or not the central panel is in the depressed condition. This observation can be made without requiring that the lid be opened or that any other manipulation be made to the closure.

Some embodiments of the closure of this invention readily accommodate fabrication of the closure seal from a material different from the closure body material. This permits optimization of the body material and seal material to better accommodate their different functions.

The tamper-indicating seal can be employed with closures having very small dispensing orifices. The ease of operation, including the step of puncturing the seal, is generally independent of dispensing orifice size.

It will be readily observed from the foregoing detailed description of the invention and from the illustrations thereof that numerous other variations and modifications may be effected without departing from the true spirit and scope of the novel concepts or principles of this invention.

What is claimed is:

1. A closure for an opening to a container interior, said closure comprising:

a base;

said base including a body that is molded from at least a first material and that is adapted for mounting to said container around said opening, said base body defining a dispensing orifice for communicating with said container opening;

said base first material also defining at least a portion of a tamper evident seal unitary with said base body and extending across said dispensing orifice; and a lid adapted to be mounted on said base to cooperate with said base for occluding said dispensing orifice in a closed position over said base body and for being moved away from said closed position to permit the dispensing of container-stored contents out of said orifice, said lid including (a) a peripheral frame, (b) a flexible panel that is connected with said frame and that is normally biased to an outwardly convex configuration as viewed from outside said lid, (c) only one reduced thickness, film hinge joining the periphery of said flexible panel to said lid peripheral frame for accommodating flexure of said flexible panel to a self-maintained inverted inwardly concave configuration, and (d) a penetrator member extending from said flexible panel for penetrating said seal when said flexible panel is in said inwardly concave configuration.

2. The closure in accordance with claim 1 in which said base includes only said first material;

said first material is a synthetic polymer; and an annular groove is molded in said first material at the periphery of said seal to define a reduced thickness, frangible portion of said first material.

3. The closure in accordance with claim 2 in which said first material defines an inwardly facing surface on said seal across said dispensing orifice;

said groove is defined by (1) a cylindrical surface extending into said first material from said inwardly facing surface, (2) a radially oriented annular surface extending from said cylindrical surface, and (3) a frustoconical surface extending from said annular surface to said inwardly facing surface.

4. The closure in accordance with claim 1 in which said base includes a second material in addition to said first material; and said first and second materials have been coinjection molded to form said base with said second material being located within said first material.

5. The closure in accordance with claim 1 in which said flexible panel is dome-shaped when said panel is normally biased to said outwardly convex configuration.

6. The closure in accordance with claim 5 in which said film hinge is a generally annular, reduced thickness, film hinge joining the periphery of said dome-shaped flexible panel to said lid peripheral frame.

7. The closure in accordance with claim 1 in which said seal is a thin membrane.

8. The closure in accordance with claim 1 in which said penetrator member is a tubular spike having a pointed end.

9. The closure in accordance with claim 1 in which said penetrator member extends into said dispensing orifice and through the penetrated seal when said flexible panel is in said inwardly concave configuration.

10. The closure in accordance with claim 1 in which said lid is hingedly connected to said base body.

11. The closure in accordance with claim 1 in which said base body includes an upwardly projecting spout defining said dispensing orifice.

12. The closure in accordance with claim 11 in which said lid includes an annular sealing collar extending inwardly from said flexible panel radially beyond said penetrator member for sealingly engaging said spout.

13. A closure for an opening to a container interior, said closure comprising:

a base that is coinjection molded from first and second materials for mounting to said container around said opening, said base having an exterior and an interior, said first material defining said exterior, and said second material being encapsulated by said first material, said base defining a dispensing orifice for communicating with said container opening, said base including a tamper evident seal unitary with said first and second materials and extending across said dispensing orifice; and a lid adapted to be mounted on said base to cooperate with said base for occluding said dispensing orifice in a closed position over said base body and for being moved away from said closed position to permit the dispensing of container-stored contents out of said dispensing orifice, said lid including (a) a peripheral frame, (b) a flexible panel that is connected to said frame and that is normally biased to an outwardly convex configuration as viewed from outside said lid, (c) at least one hinge connecting said flexible panel to said frame for accommodating flexure of said flexible panel to an inverted inwardly concave configuration, and (d) a penetrator spike extending from said flexible panel for penetrating said seal when said flexible panel is in said inwardly concave configuration.

14. The closure in accordance with claim 13 in which said hinge is a generally annular, reduced thickness, film hinge joining the periphery of said flexible panel to said lid peripheral frame; and said frame, hinge, and flexible panel are unitary and molded solely from said first material.

15. The closure in accordance with claim 13 in which said peripheral frame is capable of supporting said closure upside down on a support surface when said flexible panel is in said inwardly concave configuration.

16. The closure in accordance with claim 13 in which an annular groove is molded in said first material at the periphery of said seal to define a reduced thickness, frangible portion of said first material;

said first material defines an inwardly facing surface on said seal across said dispensing orifice; and said groove is defined by (1) a cylindrical surface extending into said first material from said inwardly facing surface, (2) a radially oriented annular surface extending from said cylindrical surface, and (3) a frustoconical surface extending from said annular surface to said inwardly facing surface.

17. The closure in accordance with claim 13 in which said seal is a thin membrane.

18. The closure in accordance with claim 13 in which said spike is tubular and has a pointed end.

19. The closure in accordance with claim 13 in which said spike extends into said dispensing orifice and through the penetrated seal when said flexible panel is in said inwardly concave configuration.

20. The closure in accordance with claim 13 in which said lid is hingedly connected to said base body.

21. The closure in accordance with claim 13 in which said base body includes an upwardly projecting spout defining said orifice.

22. The closure in accordance with claim 21 in which said lid includes an annular sealing collar extending inwardly from said flexible panel radially beyond said penetrator member for sealingly engaging said spout.

23. The closure in accordance with claim 13 in which said flexible panel is dome-shaped when said panel is normally biased to said outwardly convex configuration.

* * * * *